United States Patent [19]

Calentine

[11] 4,062,540

[45] Dec. 13, 1977

[54] BOWLING BALL CONTROL DEVICE

[76] Inventor: Danny D. Calentine, 4002 York Road, South Bend, Ind. 46614

[21] Appl. No.: 714,295

[22] Filed: Aug. 16, 1976

[51] Int. Cl.[2] ..... A63B 71/14

[52] U.S. Cl. ..... 273/54 B; 2/21; 273/63 A

[58] Field of Search ..... 273/54 B, 63 R, 63 A, 273/63 B; 2/21, 161 A

[56] References Cited

U.S. PATENT DOCUMENTS

| | | | |
|---|---|---|---|
| 1,733,933 | 10/1929 | Beltz | 2/21 UX |
| 2,827,635 | 3/1958 | Rasmus | 273/54 B UX |
| 3,046,561 | 7/1962 | Marinese et al. | 273/54 B UX |
| 3,102,725 | 9/1963 | Jarus | 273/63 B |

*Primary Examiner*—Anton O. Oechsle

*Attorney, Agent, or Firm*—Hobbs & Green

[57] ABSTRACT

A device for controlling a bowling ball having a thumb hole therein, in which a sleeve-like member for slipping on the bowler's thumb and into the hole of the ball, has one or more friction pads on the outside of the member adjacent the back of the thumb when disposed in the member for transmitting a control force between the thumb and the bowling ball. The sleeve-like member is held on the thumb preferably by a strap attached to the member and extending around the wrist of the bowler, and a cylindrical sleeve is disposed in and secured in the thumb hole of the bowling ball. The sleeve-like member may have a plurality of removable and replaceable friction pads, and the sleeve may have a friction pad along the internal surface thereof for engagement by the friction pads on the sleeve-like member.

13 Claims, 13 Drawing Figures

Fig. 1
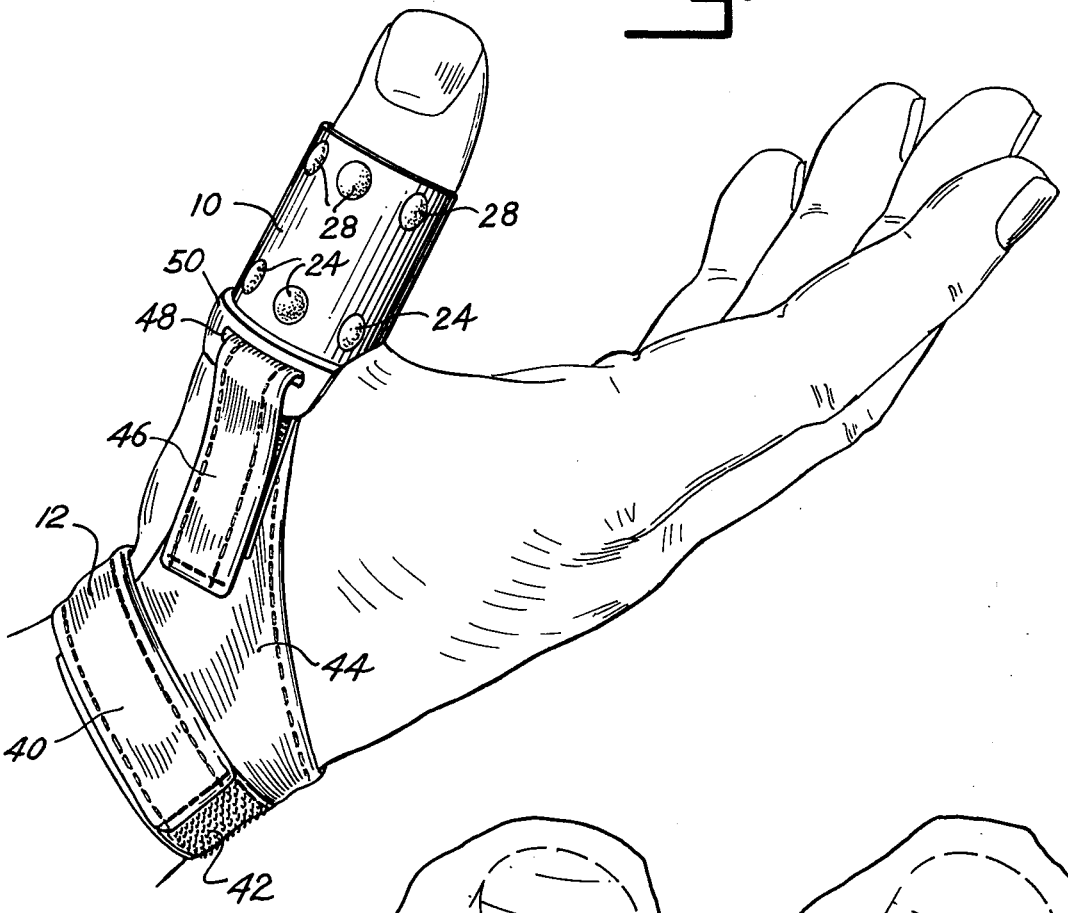
Fig. 2
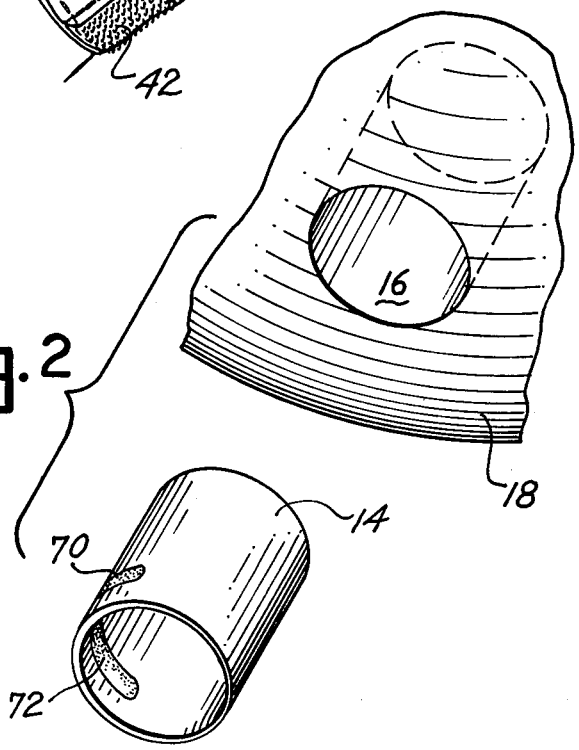
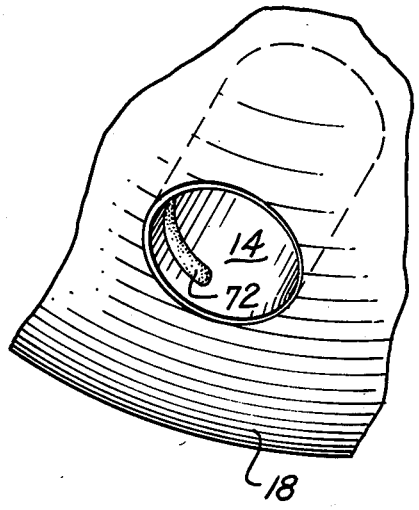
Fig. 3

BOWLING BALL CONTROL DEVICE

The invention relates to a control and release device and system for use with bowling balls, and involves the use of a range of low and high friction materials in the construction, whereby a person can adjust from a quick release to a relatively slow release. A bowler in utilizing this invention can control the number and direction of the revolutions of the ball, control the curve of the ball and also develop a particular pin action. Since bowling lanes, pins, and climate vary, the purpose of the versatility in the release and control of the ball is so that the bowler can deal with these variable parameters. This can be done now in the conventional method and done without the use of any aids, but at present the existing method cannot be sustained for any length of time.

It has been found that in conventional bowling with only the thumb bearing in the thumb hole of the ball, it is impossible to get a consistent release with each delivery. A bowler has to deal with a number of variables simultaneously to achieve and maintain a particular release. For example, a bowler is always confronted with increases or decreases in thumb size during bowling, or from one day to the next, or at times from winter to summer. It is a problem which constantly must be met. Further, the friction between a bowler's thumb and the thumb hole in the ball is not always the same. Sometimes the hands are covered with perspiration, sometimes they are dry, sometimes they are soft, and sometimes they are hard and rough. Consequently, with the variation in thumb size and the variation in hand conditions, it is very difficult, if not impossible, to maintain a consistent release of the ball.

Still further, the thumb hole in the ball in most instances is round and the shape of the thumb is somewhat flat or oblong, and, of course, the thumb is jointed which, because of the shape of the thumb, and the fact that it bends sometimes, causes binding when the thumb is released from the thumb hole in the ball. This gives inadequate control of the ball and poor results. The thumb primarily acts as a guide in directing the ball and also applies pressure in holding the ball and pressure in obtaining different releases. Because of its poor physical characteristics and inconsistencies, maintaining a confident release is impossible. One of the principal objects of the present invention is to eliminate the foregoing inconsistencies.

The invention involves the following characteristics:

A circular piece is placed and held on the thumb with an adjustable strap. The material of the bearing surface of the thumb piece is tough and has exceptionally good wear qualities to maintain a consistent frictional surface. The thumb piece is designed to enter the thumb hole in the ball the same distance each time. The thumb piece bears in a precision circular thumb hole in the ball. The thumb piece is designed to cover and extend beyond the joint of the thumb at the back only to eliminate the problem of the joint binding in the thumb hole.

In order to achieve the ultimate solution and make the game of bowling more competitive and honest, the problems of the thumb should be eliminated. Because of the characteristics of and inconsistencies in the thumb, bowling as it is now played is not an honest result of a bowler's effort. To a bowler it is very discouraging and unjust to the sport to be plagued with the inconsistent thumb. Another object of the invention is to provide a device which eliminates the inconsistencies of the thumb.

In addition to the above mentioned features, the thumb piece of the present invention has one basic length for each size thumb. In other words, bowlers with short thumbs will have the same length friction surface as a bowler with a longer thumb. Thus, the design of the thumb piece gives all bowlers equality in release and control of the ball.

In the device embodying the present invention, the thumb piece is notched and shaped to bear mainly against the muscle of the thumb and avoid the areas where the bone is close to the skin, while making it as comfortable as possible without detracting from its function. A very basic quality of this invention is a semi-automatic gripping release. In order words, the thumb piece has several removable and interchangeable high friction inserts. When the thumb is placed in the ball, these inserts come in contact with a high friction ring which is permanently secured in the thumb hole in the ball. This ring is part of a complete tubular insert which is also secured in the thumb hole of the ball. It is located near the edge of the thumb hole, flush with the inside surface of the tubular insert and encircles most of the hole. This high friction ring has two functions. It contacts the upper row of high friction inserts in the thumb piece, allowing a bowler to hold and release the ball with a relaxed grip, which has been found essential for effective bowling for prolonged periods of time.

In order to achieve this in conventional bowling without dropping the ball, the fit between the thumb and the thumb hole has to be precise. A bowler may start with that precise fit but eventually, as he bowls, he will lose effective control uless he constantly maintains that fit by adding and removing thumb hole shims.

In the present invention, gripping pressure can be adjusted to suit each individual by removing any or all of the upper inserts in the thumb piece. The second purpose of the high friction ring is to contact the last row of high friction inserts in the thumb piece. These high friction surfaces come into contact as the thumb leaves the ball. In the proper release of the ball, the thumb comes out of the ball first and the fingers last. With a right handed bowler, as he releases the ball, the fingers turn the ball counter-clockwise from a starting position from approximately under the ball to the release when they are somewhere on the side of the ball. Of course, the thumb is turning in towards the body when releasing the ball. The purpose of these particular high friction inserts is to cause an instantaneous slowing in the sliding of the thumb piece from the ball. This momentary catch in the release gives the fingers as they are turning the ball extra lifting power. This has been found to be very advantageous on certain types of bowling lanes. In the present invention, this momentary catch is adjustable to a bowler's needs by removing any or all of the last row of high friction inserts in the thumb piece.

In the device embodying the invention, there are two sets of high friction inserts in the thumb piece. One set has a different co-efficient of friction from the other set. They are removable and interchangeable in any combination. Therefore, they are all the same in shape and size and differ only in their coefficients of friction. In order to distinguish the difference, they may be color coded.

It is important to control the size of the thumb hole. This may be attained by drilling the thumb hole conventionally and then following that with a ream to size the hole, or by using a plastic tubular sleeve secured in the thumb hole. It is slightly longer than the thumb, uniform in thickness, and completely encircles the thumb hole. The material used is of the same weight as the material it displaces and has exceptionally good wear qualities. The sleeve is tapered or notched at the top of the hole, and the width of this is the approximate width of the thumb. The sleeve is positioned at the edge of the thumb hole and the location of the taper or notch is positioned where the thumb leaves the ball before permanently fastening. At the edge of the thumb hole above the notch or taper the ball has sufficient radius to prevent the thumb from touching any sharp edges as it leaves the ball. As mentioned before, this sleeve has inserted therein a high friction ring.

The thumb piece may be made of solid plastic or metal which is coated with plastic. The plastic material is tough and has exceptionally good wear characteristics, and lends itself to being made with various co-efficients of friction. It may be made in left hand and right hand forms, and in diameters to fit all thumb sizes. Each diameter piece has basically one length, and that length extends out to or beyond the joint of the thumb. Also, each diameter thumb piece accommodates a particular range of thumb sizes. A padded shim may be made in different thicknesses to compensate for the different thumb sizes. This shim is secured to the inside of the thumb piece at the back of the thumb.

The inside of the thumb piece is contoured and designed as thin as possible in the area which comes between the inside of the thumb and the ball. The purpose of this is to place the thumb as close as possible to the gripping surface of the ball. This minimizes the gripping pressure as much as possible. This area of the piece is not padded. The back of the thumb piece is considerably thicker and is tapered from one end to the other to follow the slope of the thumb. It is in this area where the padded shim is secured and where the high friction removable inserts are placed.

At the back of the thumb piece is an extension which has two functions. One is to receive the adjustable strap which holds it on the thumb and the other is to serve as a stop for the thumb piece. This stop allows a bowler to insert the thumb the same distance into the ball for each release. It extends horizontally with the center of the thumb piece to receive the strap, and vertically to the center to act as a stop. Part of its contour also is to facilitate tooling.

At the other end of the thumb piece and at approximately 180 degrees from the above mentioned extension, is a rectangular notch. The center of the notch is centered with the inside of the thumb, and the notch is wide enough to allow the sides of the thumb to clear it but is preferably sufficiently less than half the diameter of the thumb piece. It is necessary for the notch to be less then half the diameter in order to maintain the bearing surface with the hole for the full length of the thumb piece. The notch extends from behind the joint of the thumb out to the end of the thumb piece. The purpose of avoiding this area of the thumb piece is significant, in that it is necessary for a bowler to have physical contact or the sense of touch with the ball in order to have ultimate control and guidance of the ball.

The padded shims previously mentioned may be made of two or three types of material which are secured together. The material which touches the thumb is preferably of a thin, strong, low friction material like nylon, to prevent irritating the thumb and causing sores. The material on the opposite side is secured to the thumb piece and has a much higher friction surface. Disposed between these two materials may be a compressible, low density foam of one of several thicknesses to accommodate different thumb sizes. The combination of the two outer materials with or without the foam allows one size thumb piece to fit a particular range of thumb sizes. The strap which holds the thumb piece on the thumb is of a strong soft material, and fastens around the wrist with Velcro self-gripping fastener.

The foregoing problems solved by the present device and the device embodying the present invention will be more fully understood by reference to the accompanying drawings wherein:

FIG. 1 is a perspective view showing the thumb piece of the present device mounted on a bowler's hand;

FIG. 2 is a fragmentary, perspective view of a portion of a bowling ball and a sleeve insert therefor, showing the sleeve separated from the ball;

FIG. 3 is a fragmentary, perspective view of a bowling ball showing the sleeve of FIG. 2 inserted in the thumb hole thereof;

Figure 4:
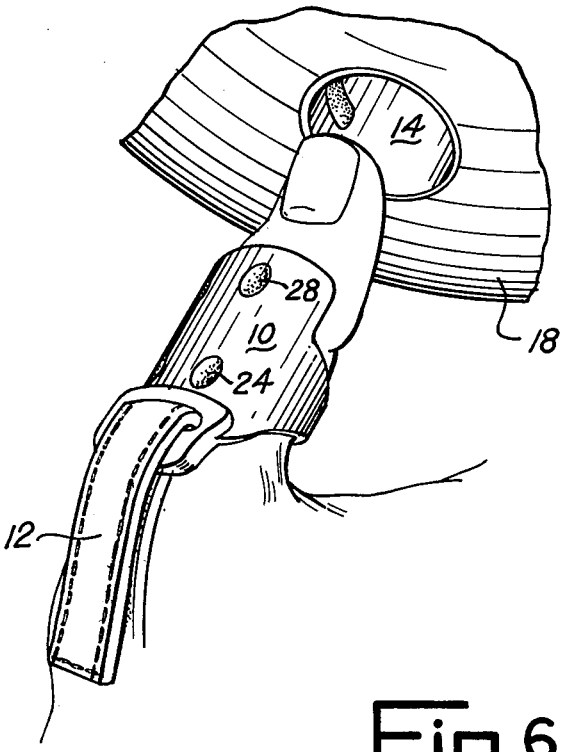
FIG. 4 is a fragmentary, perspective view of a bowling ball showing the manner in which the present device is assembled.
Figure 5:
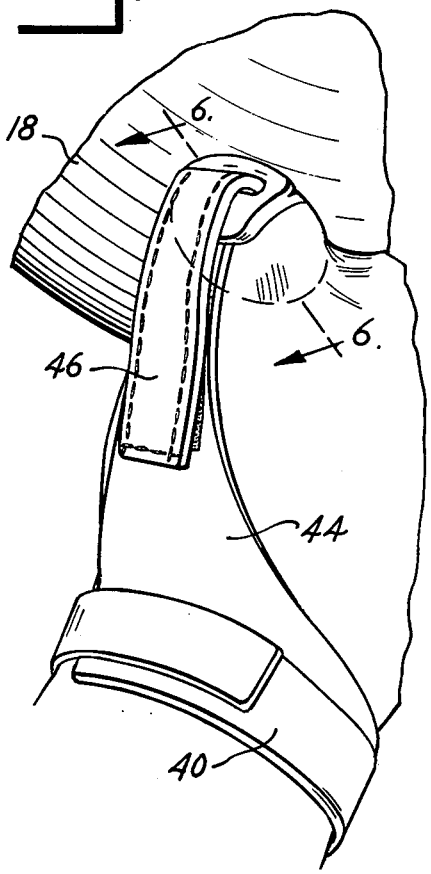
FIG. 5 is a fragmentary, perspective view of a bowling ball and a bowler's hand showing the manner in which the thumb is inserted in the thumb hole of the ball.
Figure 6:
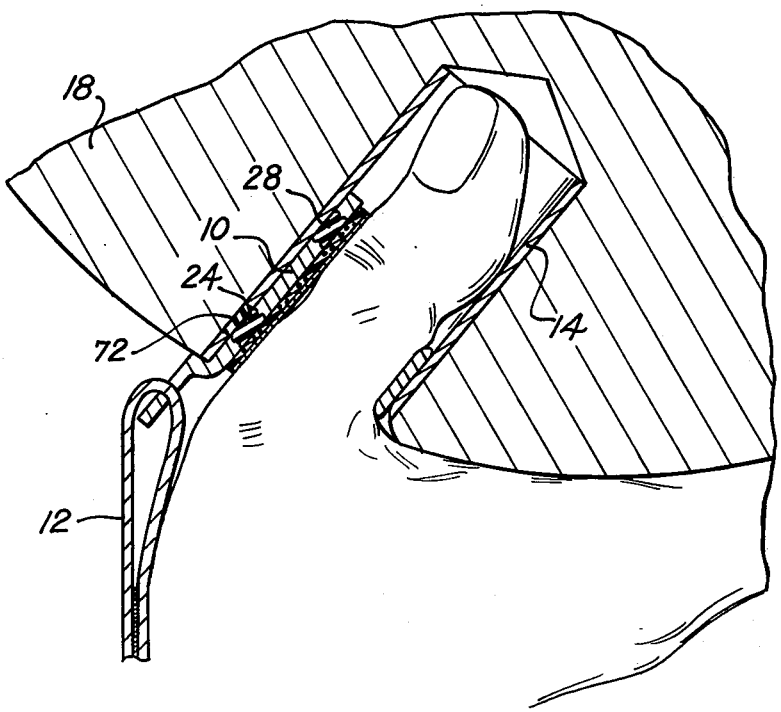
FIG. 6 is a cross sectional view of the bowling ball and the present device showing the manner in which the device is used.
Figure 7:
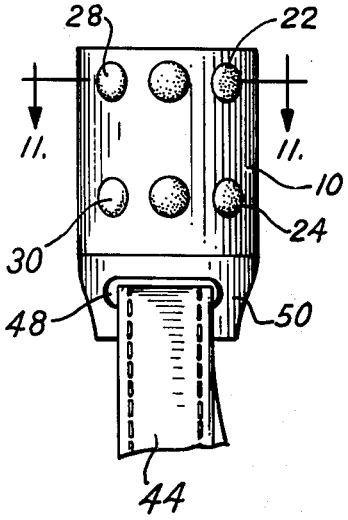
FIGS. 7, 8 and 9 are elevational views of the thumb piece of the present device.
Figure 8:
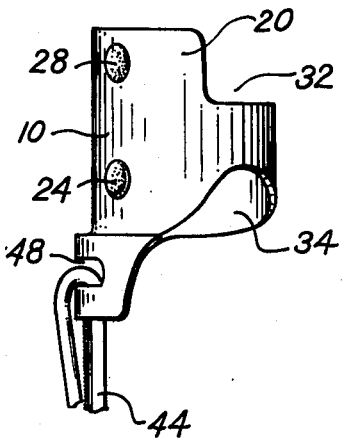
Figure 9:
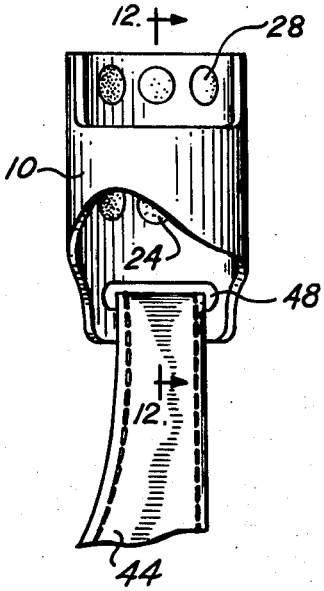
Figure 10:
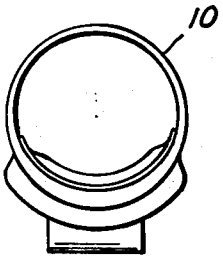
FIG. 10 is an end view of the thumb piece.
Figure 11:
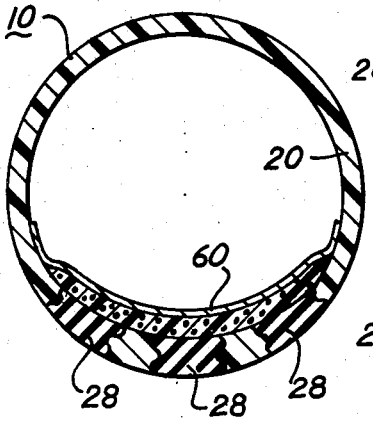
FIG. 11 is an enlarged transverse cross sectional view of the thumb piece, the section being taken on line 11 — 11 of FIG. 7.

Referring more specifically to the drawings, numeral 10 indicates generally the thumb piece and 12 a strap assembly for securing the thumb piece to the hand of the bowler, the thumb piece and strap being shown secured to a bowler's hand. The sleeve 14 which is inserted in the thumb hole 16 of a bowling ball 18 is shown in FIGS. 2 and 3.

The thumb piece 10 consists of a generally cylindrical-shaped, rigid sleeve 20 of essentially rigid plastic material or other similar composition which will hold its shape when in use by the bowler. The rear side of the thumb piece is provided with a series of forward and rearward holes 22 and 24, each hole containing a frictional insert 20 and 30 of the respective series. The opposite side of the thumb piece is notched as illustrated at numerals 32 and 34 in order to permit the bowler to have a feel for the ball with the thumb when the ball is being released. The sleeve 20 is of a size which will permit it to slip freely but snugly into sleeve 14, the internal diameter of sleeve 14 and the external diameter of sleeve 20 being such that a free movement of the sleeves relative to one another is permitted with or without the friction inserts 28 and 30.

The sleeve 20 slips on the thumb with notches 32 and 34 on the inside facing the index finger, and is held in place by strap assembly 12 consisting of a wrist band 40 having Velcro 42 or other securing means for adjustably holding the band firmly on the bowler's wrist. A strap 44 is secured to the band and has a loop 46 extending through a slot 48 in extension 50 of sleeve 20 of the thumb piece, and is secured to the body of the strap 44 so that the thumb piece will be retained firmly in place by the strap assembly. The band 40 and strap 44 are of flexible material which will conform readily to the contour of the wrist and hand.

Figure 12:
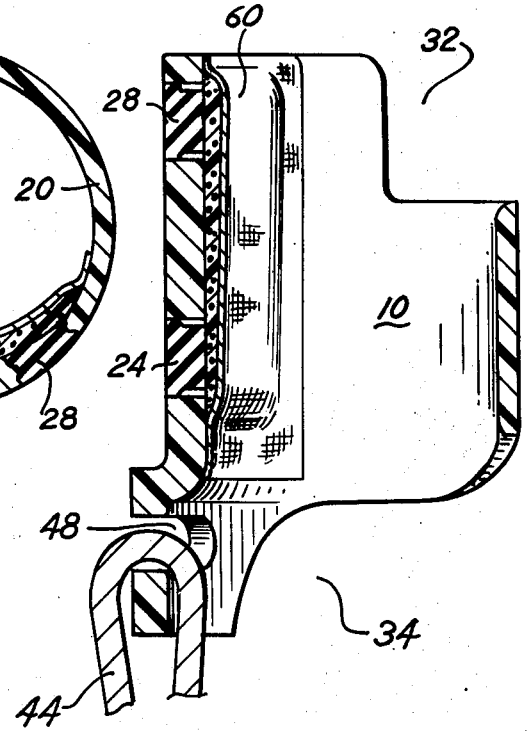
FIG. 12 is an enlarged cross sectional view of the thumb piece, the section being taken on line 12 — 12 of FIG. 9.

The thumb piece preferably has a pad 60 secured to the inner side of the sleeve at a point corresponding to the back of the thumb, and as shown, is compressible and preferably has an insert which increases in thickness toward the forward end of the thumb piece, i.e. toward the upper end of the thumb piece as seen in FIG. 12, thus tilting the forward end of the thumb toward notch 32 and thus into contact with the surface of the sleeve 14 in the thumb hole, providing better control of the ball during the releasing operation. Different flexible pads may be provided for adapting the thumb piece to the thumb of different bowlers and to provide maximum comfort to the bowler and effective control of the ball. The pad and tapered member may be of various materials and may be varied in size and shape to satisfy requirements.

The sleeve 14 which fits snugly in the thumb hole is secured by cement, glue or other suitable material in the hole and is provided with a circumferentially disposed slot 70 in which an insert 72 of friction material is disposed. The friction material cooperates with friction inserts 28 and 30 to provide effective friction action during the release of the ball, and hence improves control of the ball by the thumb piece as the bowler releases the ball. The sleeve is constructed of relatively rigid plastic or similar material, and normally remains permanently in the thumb hole of the ball.

Figure 13:
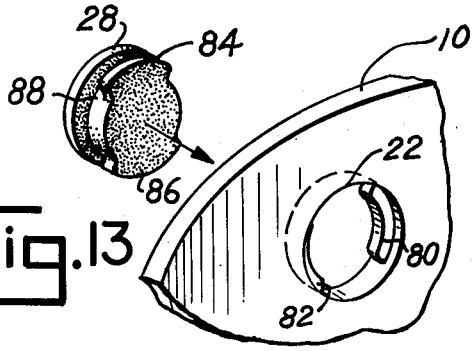
FIG. 13 is a fragmentary view of the thumb piece shown in the preceding figures and illustrating the manner in which plastic or rubber inserts are mounted in the thumb piece.

Inserts 28 and 30 may be secured in their respective holes in sleeve 20 by any suitable means, FIG. 13 illustrating one suitable method of releasably securing the inserts in hole 22. The internal wall of the hole is provided with two rib segments 80 and 82 and the insert is provided with segments 84 and 86, the two segments on the insert passing between the ends of the rib inserts until groove 88 matches the groove segments, at which time the inserts are rotated to lock the inserts in place in their respective holes 22 or 24. The inserts 28, 30 and 72 may be changed to obtain various frictional relationships between the thumb piece and sleeve 14 so that the bowler can effectively obtain the required control during the thumb releasing operation.

In the use and operation of the present bowling ball device, thumb piece 10 is mounted on the thumb and held securely in place by strap assembly 12 as illustrated in FIGS. 1, 4, 5 and 6. When the bowler uses the ball, the thumb piece is inserted in sleeve 14, which has been secured in place in the thumb hole of the ball, and the bowler then performs the normal bowling operation, first releasing the thumb using the friction inserts 28 and 30 in combination with insert 72 to provide the desired control of the ball by the back of the thumb as the thumb is withdrawn from the hole. Initially, the soft part on the front of the bowler's thumb is in contact with the inside surface of sleeve 14 to provide adequate gripping action and to control the ball during the swing prior to the release of the ball, then, as the thumb is withdrawn, the frictional inserts 28, 30 and 72 provide the desired control, particularly during the final stages of the ball releasing operation.

While a number of advantages have been pointed out herein, one advantage is the effective control of the ball by the thumb piece in relation to sleeve 14. The thumb piece eliminates the variations in thumb size which often occur during extended periods of bowling, and avoids injury to the thumb which would interfere with the bowler's game from one time to another. Thus the bowler has effective control over the ball over long periods of time without interference from the variations in thumb and/or other conditions, including dampness, perspiration or weather conditions, and he can vary the control characteristics by changing the inserts to satisfy requirements. Likewise, the sleeve 20 can be adjusted to various thumb sizes by changing the pad 60 to accommodate various size thumbs from one bowler to another.

While only one embodiment of the present invention has been described in detail herein, various changes and modifications may be made without departing from the scope of the invention.

I claim:

1. A device for controlling a bowling ball having a thumb hole therein, comprising a sleeve-like member of generally cylindrical shape and of substantially rigid construction for slipping onto the bowler's thumb and into the thumb hole in the ball, said member having a friction means on the outside of the sleeve-like member adjacent the back side of the thumb when disposed in said member, said friction means having a greater coefficient of friction than the remainder of the external surface of said sleeve-like member, for transmitting a control force between the thumb and the bowling ball, and a means for retaining said sleeve-like member on the bowler's thumb.

2. A device for controlling a bowling ball as defined in claim 1 in which a cylindrical sleeve is provided for seating firmly in the thumb hole in the bowling ball, the inside diameter of said cylindrical sleeve being sufficiently large to permit such sleeve-like member to slide thereinto.

3. A device for controlling a bowling ball as defined in claim 2 in which said sleeve has a friction insert on the inner wall thereof in the position adjacent the back side of the thumb when disposed in said thumb hole of the bowling ball.

4. A device for controlling a bowling ball as defined in claim 3 in which said friction means consists of a series of friction pads disposed near the forward end of the sleeve-like member adjacent the back side of the thumb when disposed in said member.

5. A device for controlling a bowling ball as defined in claim 4 in which said friction pads are seated in holes in said sleeve-like member and said friction insert in said cylindrical sleeve is disposed in an elongated hole near the outer edge of said thumb hole.

6. A device for controlling a bowling ball as defined in claim 5 in which said means for retaining said sleeve-like member on said bowler's thumb consists of a strap attached to said sleeve-like member and having a band for extending around and being secured to the bowler's wrist.

7. A device for controlling a bowling ball as defined in claim 3 in which said friction means includes a second series of friction pads disposed on said sleeve-like member spaced rearwardly from said first series of friction pads on the same side of said sleeve-like member.

8. A device for controlling a bowling ball as defined in claim 7 in which a relatively soft insert is disposed in said sleeve-like member in the position adjacent the back side of the thumb when the thumb is inserted in said member.

9. A device for controlling a bowling ball as defined in claim 4 in which a friction pad of one friction characteristic is removable and replaceable by a friction pad of a different friction characteristic.

10. A device for controlling a bowling ball as defined in claim 1 in which said friction means consists of a series of friction pads disposed near the forward end of the sleeve-like member adjacent the back side of the thumb when disposed in said member.

11. A device for controlling a bowling ball as defined in claim 10 in which said friction means includes a second series of friction pads disposed on said sleeve-like member spaced rearwardly from said first series of friction pads on the same side of said sleeve-like member.

12. A device for controlling a bowling ball as defined in claim 1 in which a relatively soft insert is disposed in said sleeve-like member in the position adjacent the back side of the thumb when the thumb is inserted in said member.

13. A device for controlling a bowling ball as defined in claim 1 in which a slot is provided in said sleeve-like member on the front side of the thumb near the forward end thereof to permit a substantial part of the front side of the thumb to be exposed.

* * * * *